US011393420B2

(12) United States Patent
Li et al.

(10) Patent No.: US 11,393,420 B2
(45) Date of Patent: Jul. 19, 2022

(54) DISPLAY DEVICE, PIXEL CIRCUIT AND ITS DRIVING METHOD AND DRIVING DEVICE

(71) Applicants: HEFEI BOE OPTOELECTRONICS TECHNOLOGY CO., LTD., Anhui (CN); BOE TECHNOLOGY GROUP CO., LTD., Beijing (CN)

(72) Inventors: Kun Li, Beijing (CN); Dayu Zhang, Beijing (CN); Yifei Zhan, Beijing (CN); Xiaohan Ling, Beijing (CN)

(73) Assignees: HEFEI BOE OPTOELECTRONICS TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 598 days.

(21) Appl. No.: 16/331,649

(22) PCT Filed: Aug. 16, 2018

(86) PCT No.: PCT/CN2018/100784
§ 371 (c)(1),
(2) Date: Mar. 8, 2019

(87) PCT Pub. No.: WO2019/076121
PCT Pub. Date: Apr. 25, 2019

(65) Prior Publication Data

US 2021/0327378 A1 Oct. 21, 2021

(30) Foreign Application Priority Data

Oct. 18, 2017 (CN) ..... 201710972270.2

(51) Int. Cl.
*G09G 3/36* (2006.01)

(52) U.S. Cl.
CPC ..... *G09G 3/3614* (2013.01); *G09G 3/3688* (2013.01)

(58) Field of Classification Search
CPC combination set(s) only.
See application file for complete search history.

(56) References Cited

U.S. PATENT DOCUMENTS 8,743,043 B2 6/2014 Huang et al.
8,896,584 B2 11/2014 Liu
(Continued)

FOREIGN PATENT DOCUMENTS

CN 101055708 A 10/2007
CN 101276535 A 10/2008
(Continued)

OTHER PUBLICATIONS

Wang Canghong Zhang CN101055708 (English machine translation) (Year: 2007).*
(Continued)

*Primary Examiner* — Van N Chow
(74) *Attorney, Agent, or Firm* — Calfee, Halter & Griswold LLP

(57) ABSTRACT

A display device, a pixel circuit and its driving method and driving device. The driving method includes the steps of, during a frame sequence formed by successive X frames of image displaying, outputting gate signals and data signals to the pixel circuit in a first preset mode; during a frame sequence formed by successive Y frames and adjacent to the frame sequence formed by successive X frames of image displaying, outputting gate signals and data signals to the pixel circuit in a second preset mode, wherein the first preset mode is different from the second preset mode, and X and Y are positive integers not less than 2. The method can enable the charging time of the pixel circuit to be balanced in space, thereby improving image display quality.

16 Claims, 4 Drawing Sheets

(56) References Cited

U.S. PATENT DOCUMENTS

| | | | | |
|---|---|---|---|---|
| 2008/0238846 | A1* | 10/2008 | Brian | G09G 3/3648 345/87 |
| 2008/0238898 | A1 | 10/2008 | Yamanaka et al. | |
| 2009/0179875 | A1 | 7/2009 | Li et al. | |
| 2009/0256833 | A1 | 10/2009 | Huang et al. | |
| 2011/0102474 | A1 | 5/2011 | Liu et al. | |
| 2013/0016076 | A1 | 1/2013 | Liu | |
| 2017/0200412 | A1* | 7/2017 | Gu | G09G 5/005 |
| 2018/0293942 | A1* | 10/2018 | Gu | G09G 5/005 |

FOREIGN PATENT DOCUMENTS

| | | | |
|---|---|---|---|
| CN | 101963732 | A | 2/2011 |
| CN | 103943075 | A | 7/2014 |
| CN | 107507600 | A | 12/2017 |
| TW | 200933576 | A | 8/2009 |
| TW | 200943251 | A | 10/2009 |
| TW | 201303841 | A | 1/2013 |

OTHER PUBLICATIONS

Search Report and Written Opinion for International Application No. PCT/CN2018/100784 dated Oct. 31, 2018.
First Office Action for Chinese Patent Application No. 201710972270.2 dated Mar. 18, 2019.

* cited by examiner

DISPLAY DEVICE, PIXEL CIRCUIT AND ITS DRIVING METHOD AND DRIVING DEVICE

RELATED APPLICATION

The present application is the U.S. national phase entry of PCT/CN2018/100784, with an international filing date of Aug. 16, 2018, which claims the benefit of Chinese Patent Application CN201710972270.2 filed on Oct. 18, 2017, the entire disclosures of which are incorporated herein by reference.

TECHNICAL FIELD

The present disclosure relates to the field of display technologies, in particular to a driving method of a pixel circuit, a driving device of a pixel circuit, a pixel circuit and a display device.

BACKGROUND

Generally, in an ideal TFT-LCD driving model, voltages of source driving signals are distributed symmetrically with respect to the common electrode voltage Vcom, but in fact, the central voltages of said driving signals are usually deviated from Vcom to a certain degree, which results in asymmetry of positive and negative pixel voltages.

In order to solve problems caused by asymmetry of positive and negative pixel voltages, many driving modes have been proposed, such as point inversion, column inversion, row inversion, 2H1V inversion, 1H2V inversion and Z inversion. Each of these driving modes may be chosen depending on its display quality, power consumption, driving voltage magnitude, accompanying adverse factors, etc.

Z inversion is the most commonly used way of inversion at present, which makes the column inversion to achieve the effect of point inversion by means of the internal pixel structure, however, Z inversion has a serious drawback, namely, cross striation might appear during image displaying.

SUMMARY

The present disclosure aims at solving, at least to some extent, one of the technical problems in the related technologies.

According to a first exemplary embodiment of the present disclosure, a driving method of a pixel circuit is provided, which comprises the following steps: during a frame sequence formed by successive X frames of image displaying, outputting gate signals and data signals to the pixel circuit in a first preset mode; during a frame sequence formed by successive Y frames and adjacent to the frame sequence formed by successive X frames of image displaying, outputting gate signals and data signals to the pixel circuit in a second preset mode, wherein the first preset mode is different from the second preset mode, and X and Y are positive integers not less than 2.

According to an embodiment of the present disclosure, said outputting gate signals and data signals to the pixel circuit in the first preset mode comprises: grouping all rows of the pixel circuit by taking multiple rows of pixel units as one group, and in each group, outputting gate signals in a disorderly manner to all rows of pixel units in said group.

According to an embodiment of the present disclosure, said outputting gate signals and data signals to the pixel circuit in the second preset mode comprises: outputting gate signals in sequence to all rows of pixel units of the pixel circuit.

According to an embodiment of the present disclosure, when X and Y are 2, during the $N^{th}$ frame and the $(N+1)^{th}$ frame of the image displaying, gate signals and data signals are output to the pixel circuit in the first preset mode, wherein N is a positive integer; during the $(N+2)^{th}$ frame and the $(N+3)^{th}$ frame of the image displaying, gate signals and data signals are output to the pixel circuit in the second preset mode.

According to an embodiment of the present disclosure, said outputting gate signals and data signals to the pixel circuit in the first preset mode comprises: grouping all rows of the pixel circuit by taking every three rows of pixel units as one group, and in each group, outputting gate signals in the order of the first row, the third row and the second row to the pixel units.

According to an embodiment of the present disclosure, said outputting gate signals and data signals to the pixel circuit in the second preset mode comprises: sequentially outputting gate signals to the pixel units in the order from the first row to the last row.

According to an embodiment of the present disclosure, when outputting the gate signals to the pixel units, the corresponding data signals are also output to each of the pixel units in the row.

According to an embodiment of the present disclosure, data signals of the $N^{th}$ frame and the $(N+1)^{th}$ frame have opposite polarities, and data signals of the $(N+2)^{th}$ frame and the $(N+3)^{th}$ frame have opposite polarities. According to an embodiment of the present disclosure, under the condition that data signals of the $N^{th}$ frame have a negative polarity, data signals of the $(N+1)^{th}$ frame have a positive polarity, data signals of the $(N+2)^{th}$ frame have a negative polarity, and data signals of the $(N+3)^{th}$ frame have a positive polarity.

According to a second exemplary embodiment of the present disclosure, a driving device of a pixel circuit is provided, which comprises: a first driver configured to output gate signals and data signals to the pixel circuit in a first preset mode during a frame sequence formed by successive X frames of image displaying; a second driver configured to output gate signals and data signals to the pixel circuit in a second preset mode during a frame sequence formed by successive Y frames and adjacent to the frame sequence formed by successive X frames of image displaying, wherein the first preset mode is different from the second preset mode, and X and Y are positive integers not less than 2.

According to an embodiment of the present disclosure, in response to the first driver outputting gate signals and data signals to the pixel circuit in the first preset mode, the first driver groups all rows of the pixel circuit by taking multiple rows of pixel units as one group, and in each group, outputs gate signals in a disorderly manner to all rows of pixel units in said group.

According to an embodiment of the present disclosure, in response to the second driver outputting gate signals and data signals to the pixel circuit in the second preset mode, the second driver outputs gate signals in sequence to all rows of pixel units of the pixel circuit.

According to an embodiment of the present disclosure, when X and Y are 2, the first driver is configured to output gate signals and data signals to the pixel circuit in the first preset mode during the $N^{th}$ frame and the $(N+1)^{th}$ frame of the image displaying, wherein N is a positive integer; and the second driver is configured to output gate signals and data signals to the pixel circuit in the second preset mode during the $(N+2)^{th}$ frame and the $(N+3)^{th}$ frame of the image displaying.

According to an embodiment of the present disclosure, in response to the first driver outputting gate signals and data signals to the pixel circuit in the first preset mode, the first driver groups all rows of the pixel circuit by taking every three rows of pixel units as one group, and in each group, outputs gate signals in the order of the first row, the third row and the second row to the pixel units.

According to an embodiment of the present disclosure, in response to the second driver outputting gate signals and data signals to the pixel circuit in the second preset mode, the second driver sequentially outputs gate signals to the pixel units in the order from the first row to the last row.

According to an embodiment of the present disclosure, under the condition that either one of the first driver and the second driver outputs the gate signals to one row of pixel units, said either one of the drivers also outputs the corresponding data signals to each of the pixel units in said row.

According to an embodiment of the present disclosure, data signals of the $N^{th}$ frame and the $(N+1)^{th}$ frame have opposite polarities, and data signals of the $(N+2)^{th}$ frame and the $(N+3)^{th}$ frame have opposite polarities.

According to an embodiment of the present disclosure, under the condition that data signals of the $N^{th}$ frame have a negative polarity, data signals of the $(N+1)^{th}$ frame have a positive polarity, data signals of the $(N+2)^{th}$ frame have a negative polarity, and data signals of the $(N+3)^{th}$ frame have a positive polarity.

According to a third exemplary embodiment of the present disclosure, a pixel circuit is provided, which comprises any one of the above-described driving devices.

According to a fourth exemplary embodiment of the present disclosure, a display device is provided, which comprises the above-described pixel circuit.

According to a fifth exemplary embodiment of the present disclosure, a computing device is provided, which comprises: a processor; a memory storing computer-executable instructions, which, when being executed by the processor, carries out the driving method according to any one of claims 1-8.

DETAILED DESCRIPTION OF EMBODIMENTS

Figure 1:
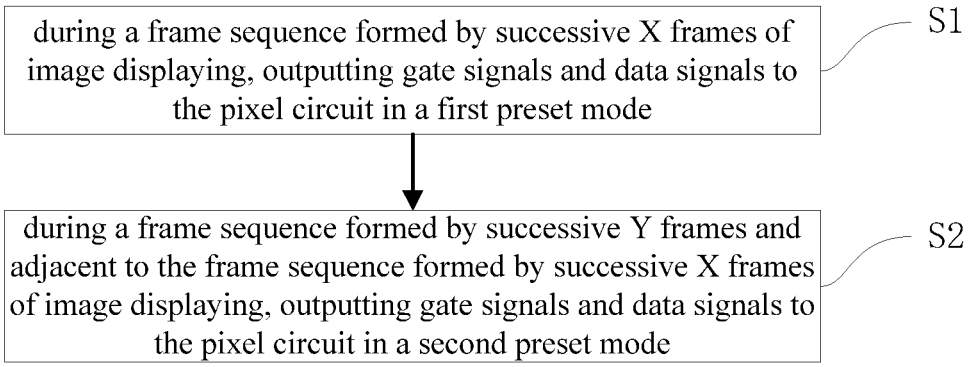
FIG. 1 RELATED ART
FIG. 1 is a flow chart of a driving method of a pixel circuit according to an embodiment of the present disclosure.

Embodiments of the present disclosure will be described in detail below, and examples of said embodiments are shown in the drawings, wherein the same or similar numerals are used throughout the drawings to denote the same or similar elements or elements having the same or similar function. The following embodiments described with reference to the drawings are merely exemplary, and they intend to explain rather than limiting the present disclosure.

The driving method of a pixel circuit, the driving device of a pixel circuit, the pixel circuit and the display device according to the embodiments of the present disclosure will now be described with reference to the drawings.

FIG. 1 is a flow chart of a driving method of a pixel circuit according to an embodiment of the present disclosure. As shown in FIG. 1, the driving method of a pixel circuit may comprise the following steps:

step S1: during a frame sequence formed by successive X frames of image displaying, outputting gate signals and data signals to the pixel circuit in a first preset mode;

step S2: during a frame sequence formed by successive Y frames and adjacent to the frame sequence formed by successive X frames of image displaying, outputting gate signals and data signals to the pixel circuit in a second preset mode, wherein the first preset mode is different from the second preset mode, and X and Y are positive integers not less than 2.

Figure 2:
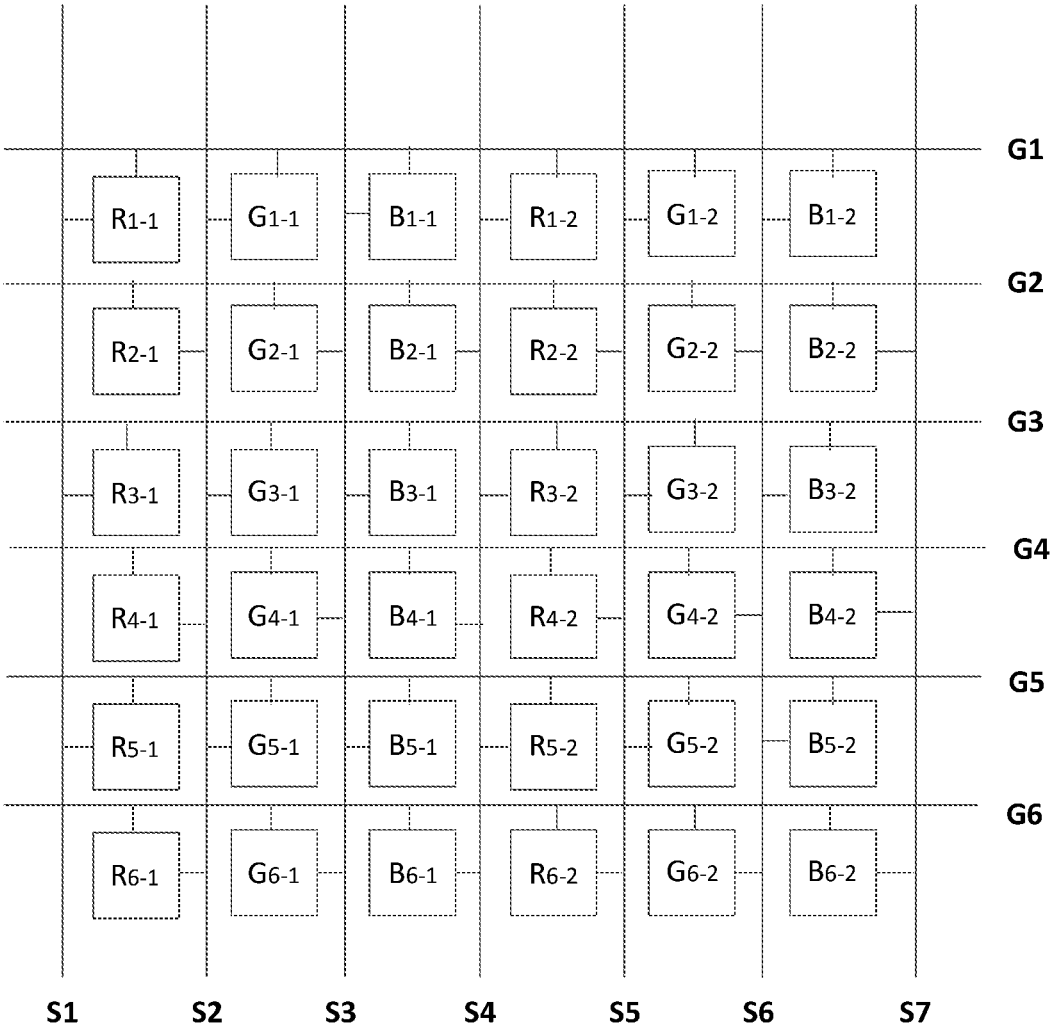
FIG. 2 is a schematic structural diagram of a pixel circuit in related technologies.

The pixel circuit shown in FIG. 2 is now used as an example. As shown in FIG. 2, $R_{i-j}$ represent red pixel units, $G_{i-j}$ represent green pixel units, $B_{i-j}$ represent blue pixel units, Gi represents a gate signal input terminal of an $i^{th}$ row of pixel units, and Sj represents a data signal input terminal of a $j^{th}$ column of pixel units, wherein i and j are positive integers. When the pixel circuit is driven by the driving mode of the conventional Z inversion, during each frame of the image displaying, gate signals are output sequentially to gate signal input terminal G1, G2, . . . G6, meanwhile, data signals are output to data signal input terminals S1, S2, . . . S7, thereby realizing display of images. However, such a driving mode will cause the appearance of cross striation on some specific images.

Figure 3:
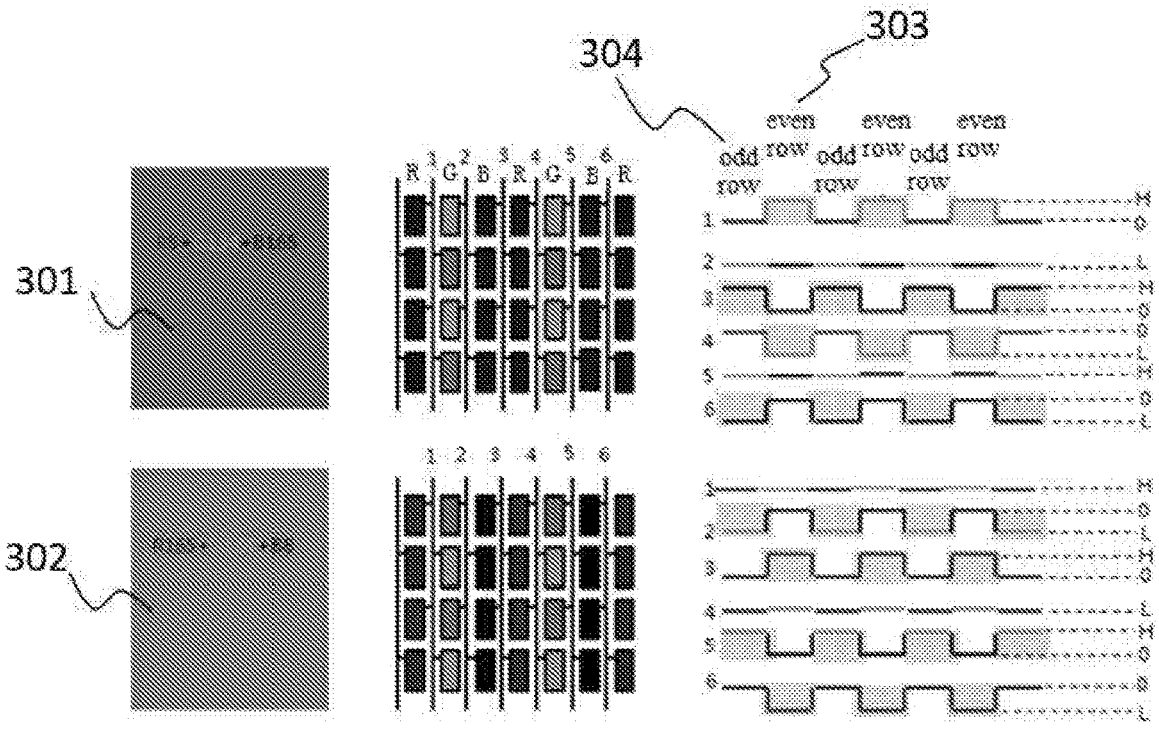
FIG. 3 is a schematic diagram of cross striation being generated when driving the pixel circuit by the driving mode of Z inversion.

FIG. 3 is a schematic diagram of cross striation being generated when driving the pixel circuit by the driving mode of Z inversion. Referring to FIG. 3, suppose that the grey scale voltage of a grade 8 grey scale is set to be 0, the grey scale voltage of a grade 134 grey scale is set to be H (positive polarity), and the grey scale voltage of a grade 156 grey scale is set to be L (negative polarity), then when the voltage on the data signal input terminal undergoes a change of 0→H or 0→L, owing to the abrupt change of voltage on the data signal input terminal and the problem of data signal delay, pixel undercharge might occur. For example, in the case of adopting the driving mode of Z inversion, when displaying the image R8+G134+B165 (i.e. red pixels of the grade 8 grey scale, green pixels of the grade 134 grey scale and blue pixels of the grade 156 grey scale) 301, the charging condition is that red pixel units (R) are basically not bright, green pixel units (G) of even rows 303 are undercharged, and blue pixel units (B) of odd rows 304 are undercharged; when displaying the image R165+G134+B8 302, the charging condition is that blue pixel units are basically not bright, red pixel units of even rows 303 are undercharged, and green pixel units of odd rows 304 are undercharged. The green pixel units have the highest brightness, and human eyes are more sensitive to the green color, therefore when there are charging differences between rows, the color mixing perceived by the human eyes will be greatly affected by the undercharge of green pixels, and the undesirable phenomenon (i.e. cross striation) of bright and dark differences between rows can be seen macroscopically, thus affecting the display quality of the image.

It can be seen from the above analyses that the main reason for the bright and dark differences between rows (i.e. cross striation) is pixel undercharge. In an embodiment of the present disclosure, the pixel circuit is driven by a first preset mode (e.g. a driving mode of the conventional Z inversion) during a frame sequence formed by successive X frames of image displaying, and by a second preset mode (e.g. a driving mode different from the conventional Z inversion) during a frame sequence formed by successive Y frames and adjacent to the frame sequence formed by successive X frames of image displaying, such that the charging time of the pixel circuit is balanced in space (i.e. between pixel units of different rows), thereby effectively alleviating the problem of bright and dark differences between rows (i.e. cross striation) and effectively improving the image display quality accordingly.

It shall be understood that the first preset mode used during the frame sequence formed by successive X frames of image displaying can be interchanged with the second preset mode used during the frame sequence formed by successive Y frames and adjacent to the frame sequence formed by successive X frames of image displaying. For example, a driving mode other than the conventional Z inversion is used during the frame sequence formed by successive X frames of image displaying, while a driving mode of the conventional Z inversion is used during the frame sequence formed by successive Y frames and adjacent to the frame sequence formed by successive X frames of image displaying.

Further, in an embodiment of the present disclosure, outputting gate signals and data signals to the pixel circuit in the first preset mode comprises: grouping all rows of the pixel circuit by taking multiple rows of pixel units as one group, and in each group, outputting gate signals in a disorderly manner to pixel units of all rows in said group; outputting gate signals and data signals to the pixel circuit in the second preset mode comprises: outputting gate signals in sequence to pixel units of all rows of the pixel circuit.

Still, the pixel circuit shown in FIG. 2 is used as an example. When outputting gate signals and data signals to the pixel circuit in the first preset mode, pixel units of the first row, the second row, the third row and the fourth row can be grouped as one group, pixel units of the fifth row, the sixth row, the seventh row and the eighth row can be grouped as one group, and so on. In each group, gate signals are output in a disorderly manner to each row of pixel units. For example, gate signals are output first to the gate signal input terminal G1 of the first row of pixel units, then to the gate signal input terminal G3 of the third row of pixel units, and then to the gate signal input terminal G2 of the second row of pixel units, and finally to the gate signal input terminal G4 of the fourth row of pixel units. Next, gate signals are output first to the gate signal input terminal G5 of the fifth row of pixel units, then to the gate signal input terminal G7 of the seventh row of pixel units, . . . , and so on until gate signal input of all rows has been completed. Of course, gate signal input of all rows can also be carried out in other orders, which is not specifically limited herein.

When outputting gate signals and data signals to the pixel circuit in the second preset mode, the gate signals are output in sequence to the pixel units. For example, gate signals are output first to the gate signal input terminal G1 of the first row of pixel units, then to the gate signal input terminal G2 of the second row of pixel units, and then to the gate signal input terminal G3 of the third row of pixel units, and next sequentially to the fourth row of pixel units, the fifth row of pixel units, the sixth row of pixel units . . . until gate signal input of all rows has been completed.

Therefore, the above-mentioned first preset mode is adopted during some adjacent frames of the image displaying, and the above-mentioned second preset mode is adopted during some subsequent frames. In this case, the charging time of the pixel circuit can be balanced in space, thereby effectively alleviating the problem of bright and dark differences between rows (i.e. cross striation) and effectively improving the image display quality, besides, this method is simple and highly reliable.

In order to help those skilled in the art to understand the present disclosure more clearly, further illustrations are given below in conjunction with specific examples of the present disclosure.

According to an embodiment of the present disclosure, when X and Y are 2, during the $N^{th}$ frame and the $(N+1)^{th}$ frame of the image displaying, gate signals and data signals are output to the pixel circuit in the first preset mode, wherein N is a positive integer; during the $(N+2)^{th}$ frame and the $(N+3)^{th}$ frame of the image displaying, gate signals and data signals are output to the pixel circuit in the second preset mode.

That is to say, when X and Y are 2, the first preset mode (e.g. the driving mode of the conventional Z inversion) can be used for driving the pixel circuit during the $N^{th}$ frame and the $(N+1)^{th}$ frame of the image displaying, and the second preset mode (e.g. the driving mode other than the conventional Z inversion) can be used for driving the pixel circuit during the $(N+2)^{th}$ frame and the $(N+3)^{th}$ frame of the image displaying. In this case, the charging time of the pixel circuit can be balanced in space, thereby effectively alleviating the problem of bright and dark differences between rows (i.e. cross striation) and effectively improving the image display quality.

In an embodiment of the present disclosure, outputting gate signals and data signals to the pixel circuit in the first preset mode comprises: grouping all rows of the pixel circuit by taking every three rows of pixel units as one group, and in each group, outputting gate signals in the order of the first row, the third row and the second row to the pixel units. Further, when outputting the gate signals to the pixel units, the corresponding data signals are also output to the pixel units in the row.

Still the pixel circuit shown in FIG. 2 is used as an example. As shown in FIG. 2, pixel units of the first row, the second row and the third row can be grouped as one group, pixel units of the fourth row, the fifth row and the sixth row can be grouped as one group, and so on. Then in each group, gate signals are output in a predetermined order.

As a specific example, during the $N^{th}$ frame of the image displaying, the gate signals is first output to the gate signal input terminal G1 of the first row of pixel units, meanwhile, the data signals are output to the data signal input terminals S1, S2, . . . , S7, and the data signals (i.e. pixel voltages) of the first row of pixel units are written in at this time. Then, the gate signal is output to the gate signal input terminal G3 of the third row of pixel units, meanwhile, the data signals are output to the data signal input terminals S1, S2, . . . , S7, and the data signals (i.e. pixel voltages) of the third row of pixel units are written in at this time. Next, the gate signal is output to the gate signal input terminal G2 of the second row of pixel units, meanwhile, the data signals are output to the data signal input terminals S1, S2, . . . , S7, and the data signals (i.e. pixel voltages) of the second row of pixel units are written in at this time. After that, the gate signals are sequentially output to the gate signal input terminals of the fourth row of pixel units, the sixth row of pixel units and the fifth row of pixel units, and when the gate signal is output to the gate signal input terminal of one row of pixel units, the corresponding data signals are output to the data signal input terminal of the pixel units in said row, so that the corresponding data signals (i.e. pixel voltages) can be written into the corresponding pixel units. The driving mode for the $(N+1)^{th}$ frame of the image displaying is the same as that for the $N^{th}$ frame, so it will not be elaborated herein any more.

As another specific example, during the $N^{th}$ frame of the image displaying, the gate signal is first output to the gate signal input terminal G2 of the second row of pixel units, meanwhile, the data signals are output to the data signal input terminals S1, S2, . . . , S7, and the data signals (i.e. pixel voltages) of the second row of pixel units are written in at this time. Then, the gate signal is output to the gate signal input terminal G1 of the first row of pixel units, meanwhile, the data signals are output to the data signal input terminals S1, S2, . . . , S7, and the data signals (i.e. pixel voltages) of the first row of pixel units are written in at this time. Next, the gate signal is output to the gate signal input terminal G3 of the third row of pixel units, meanwhile, the data signals are output to the data signal input terminals S1, S2, . . . , S7, and the data signals (i.e. pixel voltages) of the third row of pixel units are written in at this time. After that, the gate signals are sequentially output to the fifth row of pixel units, the fourth row of pixel units and the sixth row of pixel units, and when the gate signal is output to the gate signal input terminal of one row of pixel units, the corresponding data signals are output to the data signal input terminals of the pixel units in said row, so that the corresponding data signals (i.e. pixel voltages) can be written into the corresponding pixel units. The driving mode for the $(N+1)^{th}$ frame of the image displaying is the same as that for the $N^{th}$ frame, so it will not be elaborated herein any more.

In other embodiments of the present disclosure, the gate signals can also be output to pixel units of corresponding rows in the order of the third row, the first row, the second row and then the fourth row, the sixth row and the fifth row, and when the gate signal is output to the gate signal input terminal of one row of pixel units, the corresponding data signals are output to the data signal input terminals of the pixel units in said row, and the details thereof will not be elaborated herein any more.

According to an embodiment of the present disclosure, outputting gate signals and data signals to the pixel circuit in the second preset mode comprises: outputting gate signals to the corresponding rows of pixel units in the order from the first row to the last row. Further, when outputting the gate signal to one row of pixel units, the corresponding data signals are also output to the pixel units of said row.

Still the pixel circuit shown in FIG. 2 is used as an example. As shown in FIG. 2, during the $(N+2)^{th}$ frame of the image displaying, the gate signal is first output to the gate signal input terminal G1 of the first row of pixel units, meanwhile, the data signals are output to the data signal input terminals S1, S2, . . . , S7, and the data signals (i.e. pixel voltages) of the first row of pixel units are written in at this time. Then, the gate signal is output to the gate signal input terminal G2 of the second row of pixel units, meanwhile, the data signals are output to the data signal input terminals S1, S2, . . . , S7, and the data signals (i.e. pixel voltages) of the second row of pixel units are written in at this time. Next, the gate signal is output to the gate signal input terminal G3 of the third row of pixel units, meanwhile, the data signals are output to the data signal input terminals S1, S2, . . . , S7, and the data signals (i.e. pixel voltages) of the third row of pixel units are written in at this time. After that, the gate signals are sequentially output to the fourth row of pixel units, the fifth row of pixel units, and the sixth row of pixel units, and when the gate signal is output to one row of pixel units, the corresponding data signals are output to the pixel unit in said row, so that the data signals (i.e. pixel voltages) can be written into the corresponding pixel units. The driving mode for the $(N+3)^{th}$ frame of the image displaying is the same as that for the $(N+2)^{th}$ frame, so it will not be elaborated herein any more.

That is to say, the second preset mode can be the driving mode of the conventional Z inversion, and of course, when the second preset mode is the driving mode of Z inversion, the first preset mode will be a driving mode other than the Z inversion. In simple terms, two frames of pixel voltages are written in the same way (e.g. by the driving mode of forward Z inversion), and the next two frames of pixel voltages are written in a way different from that for the previous two frames (e.g. by a driving mode of reverse Z inversion), and such an alternation repeats. In this case, the charging time of the pixel circuit can be balanced in space, thereby effectively alleviating the problem of bright and dark differences between rows (i.e. cross striation) caused by the driving mode of Z inversion and effectively improving the image display quality, besides, this method is simple and highly reliable.

According to an embodiment of the present disclosure, the polarity of data signals of the $N^{th}$ frame is opposite to the polarity of data signals of the $(N+1)^{th}$ frame, and the polarity of data signals of the $(N+2)^{th}$ frame is opposite to the polarity of data signals of the $(N+3)^{th}$ frame. Further, when data signals of the $N^{th}$ frame have a negative polarity, data signals of the $(N+1)^{th}$ frame have a positive polarity, data signals of the $(N+2)^{th}$ frame have a negative polarity, and data signals of the $(N+3)^{th}$ frame have a positive polarity.

Figure 4:
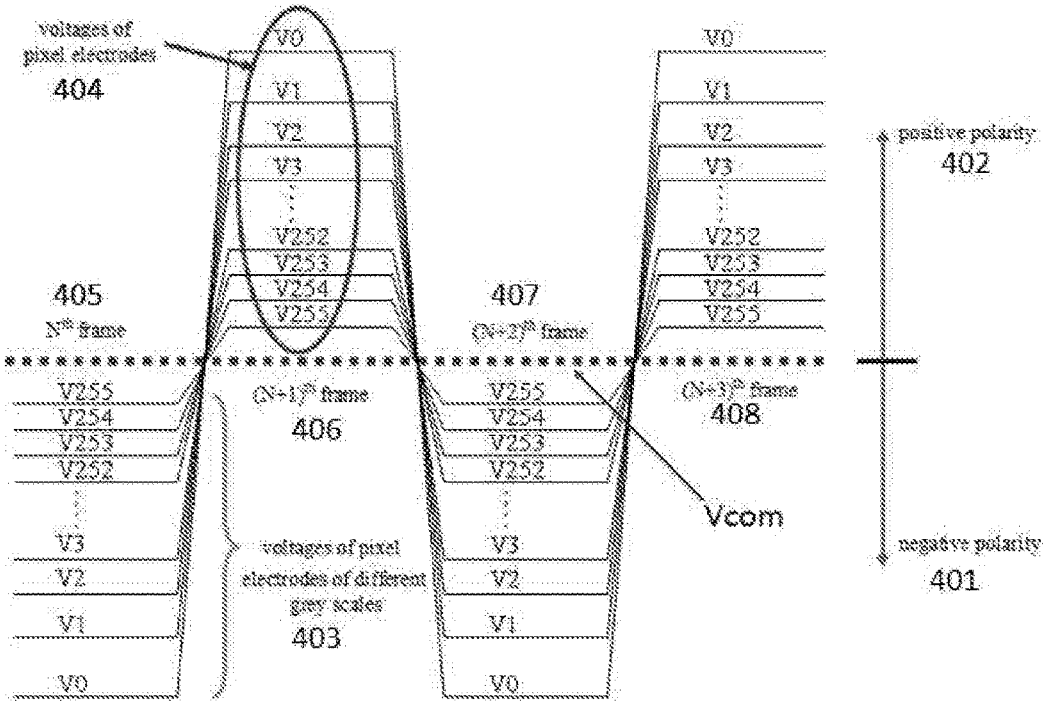
FIG. 4 is a schematic diagram of the pixel voltages of each frame during image displaying according to an embodiment of the present disclosure.

As shown in FIG. 4, the pixel circuit can be charged by the first preset mode during the $N^{th}$ frame 405 of the image displaying, and the charging voltage (i.e. data signal or pixel voltage) may have a negative polarity 401. The pixel circuit is also charged by the first preset mode during the $(N+1)^{th}$ frame 406 of the image displaying, only that the charging voltage has a positive polarity 402. Then the pixel circuit is charged by the second preset mode during the $(N+2)^{th}$ frame 407 of the image displaying, and the charging voltage has a negative polarity. The pixel circuit is also charged by the second preset mode during the $(N+3)^{th}$ frame 408 of the image displaying, only that the charging voltage of said frame has a positive polarity, and so on.

In other words, the pixel voltages 403, 404 of two frames are written in the same way, but the polarities of the written pixel voltages are opposite. The pixel voltages of the next two frames are also written in the same way, but different from the way for writing the previous two frames, and the polarities of the pixel voltages of these two frames are also opposite, and this pattern repeats. Therefore, the charging time of the pixel circuit can be balanced in space, thereby effectively alleviating the problem of bright and dark differences between rows (i.e. cross striation) and effectively improving the image display quality, besides, this method is simple and highly reliable.

In addition, the driving process when X and Y are integers greater than 2 is the same as the driving process when X and Y are equal to 2, only that the same driving mode correspond to different numbers of successive frames. As for the details, reference can be made to the driving process when X and Y are 2, and they will not be elaborated here.

In summary, the driving methods of a pixel circuit according to the embodiments of the present disclosure enable the charging time of the pixel circuit to be balanced in space by using the same driving mode during some adjacent frames of the image displaying and an additional same driving mode during some subsequent frames, thereby effectively alleviating the problem of bright and dark differences (i.e. cross striation) between rows and effectively improving the image display quality, besides, said driving method is simple and highly reliable.

Figure 5:
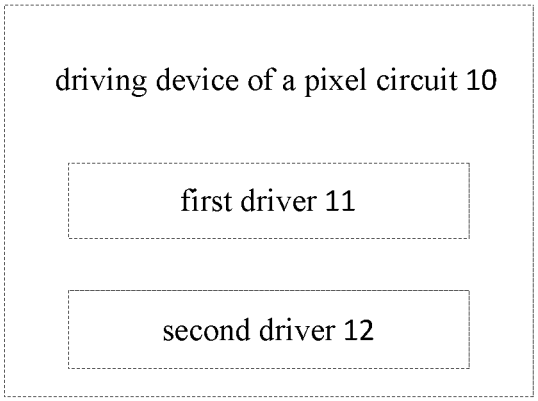
FIG. 5 is a block diagram of a driving device of a pixel circuit according to an embodiment of the present disclosure.

FIG. 5 is a block diagram of a driving device of a pixel circuit according to an embodiment of the present disclosure. As shown in FIG. 5, said driving device 10 of a pixel circuit may comprise a first driver 11 and a second driver 12.

The first driver 11 is configured to output gate signals and data signals to the pixel circuit in a first preset mode during a frame sequence formed by successive X frames of image displaying; the second driver 12 is configured to output gate signals and data signals to the pixel circuit in a second preset mode during a frame sequence formed by successive Y frames and adjacent to the frame sequence formed by successive X frames of image displaying, wherein the first preset mode is different from the second preset mode, and X and Y are positive integers not less than 2.

According to an embodiment of the present disclosure, in the case where the first driver 11 outputs gate signals and data signals to the pixel circuit in the first preset mode, the first driver 11 groups all rows of the pixel circuit by taking multiple rows of pixel units as one group, and in each group, outputs gate signals in a disorderly manner to pixel units of all rows in said group.

According to an embodiment of the present disclosure, in the case where the second driver 12 outputs gate signals and data signals to the pixel circuit in the second preset mode, the second driver 12 outputs gate signals in sequence to pixel units of all rows of the pixel circuit.

In an embodiment of the present disclosure, when X and Y are 2, the first driver 11 is configured to output gate signals and data signals to the pixel circuit in the first preset mode during the $N^{th}$ frame and the $(N+1)^{th}$ frame of the image displaying, wherein N is a positive integer; and the second driver 12 is configured to output gate signals and data signals to the pixel circuit in the second preset mode during the $(N+2)^{th}$ frame and the $(N+3)^{th}$ frame of the image displaying.

According to an embodiment of the present disclosure, in the case where the first driver 11 outputs gate signals and data signals to the pixel circuit in the first preset mode, the first driver 11 groups all rows of the pixel circuit by taking every three rows of pixel units as one group, and in each group, outputs gate signals in the order of the first row, the third row and the second row to the pixel units of the corresponding rows.

According to an embodiment of the present disclosure, in the case where the second driver 12 outputs gate signals and data signals to the pixel circuit in the second preset mode, the second driver 12 sequentially outputs gate signals to the pixel units of the corresponding rows in the order from the first row to the last row.

Further, when the first driver 11 or the second driver 12 outputs the gate signal to one row of pixel units, it also outputs corresponding data signals to each pixel unit of said row.

According to an embodiment of the present disclosure, data signals of the $N^{th}$ frame and the $(N+1)^{th}$ frame have opposite polarities, and data signals of the $(N+2)^{th}$ frame and the $(N+3)^{th}$ frame have opposite polarities.

Further, when data signals of the $N^{th}$ frame have a negative polarity, data signals of the $(N+1)^{th}$ frame have a positive polarity, data signals of the $(N+2)^{th}$ frame have a negative polarity, and data signals of the $(N+3)^{th}$ frame have a positive polarity.

It shall be noted that as for undisclosed details of the driving device of a pixel circuit in the embodiment of the present disclosure, reference can be made to the details disclosed in the driving method of a pixel circuit in the embodiment of the present disclosure, and they will not be elaborated here.

In the pixel circuit driving device according to the embodiments of the present disclosure, the first driver uses the same driving mode during some adjacent frames of the image displaying and the second driver uses an additional same driving mode during the some subsequent frames, such that the charging time of the pixel circuit is balanced in space, thereby effectively alleviating the problem of bright and dark differences (i.e. cross striation) between rows and effectively improving the image display quality. Besides, said driving modes of the driving device are simple and highly reliable.

Figure 6:
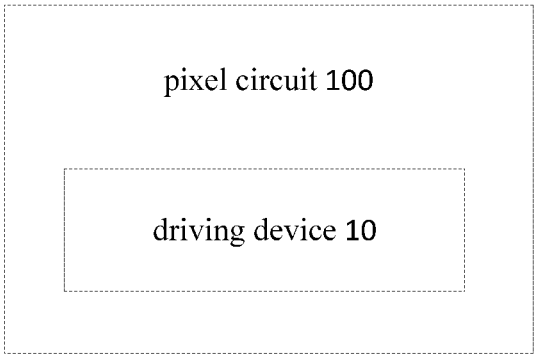
FIG. 6 is a block diagram of a pixel circuit according to an embodiment of the present disclosure.

FIG. 6 is a schematic block diagram of a pixel circuit according to an embodiment of the present disclosure. As shown in FIG. 6, the pixel circuit 100 of the embodiment of the present disclosure comprises the above-mentioned driving device 10.

By means of the above-mentioned driving device, the pixel circuit of the embodiment of the present disclosure can enable the charging time of the pixel circuit to be balanced in space, thereby effectively alleviating the problem of bright and dark differences (i.e. cross striation) between rows and effectively improving the image display quality, besides, it is highly reliable.

Figure 7:
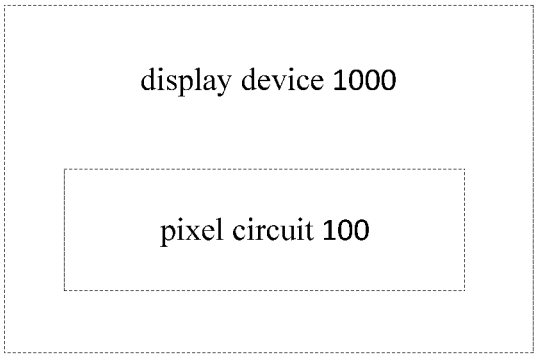
FIG. 7 is a block diagram of a display device according to an embodiment of the present disclosure.

FIG. 7 is a block diagram of a display device according to an embodiment of the present disclosure. As shown in FIG. 7, the display device 1000 of the embodiment of the present disclosure comprises the above-mentioned pixel circuit 100.

By means of the above-mentioned pixel circuit, the display device of the embodiment of the present disclosure effectively alleviate the problem of bright and dark differences (i.e. cross striation) between rows and effectively improve the image display quality, besides, it is highly reliable.

Figure 8:
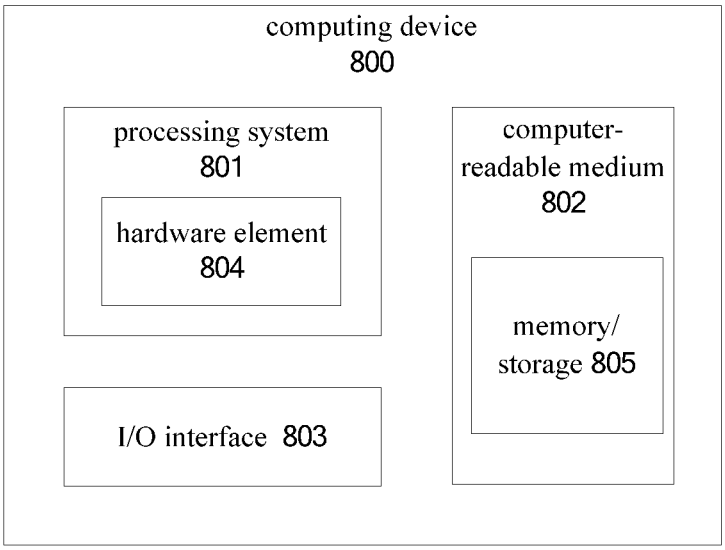
FIG. 8 shows an exemplary computing device that can implement the various technologies described herein.

FIG. 8 shows an exemplary computing device 800 that can implement the various technologies described herein. The computing device 800 can, for example, be a server, a device (e.g. a client device) associated with a client, a system on chip and/or any other appropriate computing devices or computing systems.

The exemplary computing device 800 as shown in the figure comprises a processing system 801, one or more computer-readable mediums 802 and one or more I/O interfaces 803 which are coupled to one another communicatively. Although not shown in the figure, the computing device 800 may further comprise system buses for coupling various components to one another or other data and command transmission systems.

The processing system 801 represents functionality of using the hardware to perform one or more operations. Correspondingly, the processing system 801 is shown in the figure to include a hardware element 804, which can be configured as a processor, a functional block, etc. For example, the processor can be consisting of semiconductors and/or transistors (e.g. electronic integrated circuits (ICs)).

In such a context, processor-executable instructions can be electronic executable instructions.

The computer-readable medium 802 is shown in the figure as including a memory/storage 805. The memory/memory device 805 may comprise a volatile medium (e.g. a random access memory (RAM)) and/or a non-volatile medium (e.g. a read only memory (ROM), a flash memory, an optical disc, a magnetic disc, etc.). The memory/storage 805 may comprise a fixed medium (e.g. RAM, ROM, fixed hard disk drive, etc.) and a removable medium (e.g. flash memory, removable hard disc drive, optical disc, etc.).

The one or more input/output interfaces 803 represent functionalities of allowing the user to use various input devices to input commands and information to the computing device 800 and allowing the use of various output devices to present information to the user and/or other components or devices. Examples of the input devices include keyboards, cursor control devices (e.g. mouses), microphones (e.g. for voice input), scanners, touch functionality (e.g. capacitive or other sensors configured to detect physical touches), cameras (e.g. using visible wavelengths or invisible wavelengths like infrared frequencies to detect movements of such as gestures, that do not involve any touch), and so on. Examples of the output devices include display devices (e.g. monitors or scanners), speakers, printers, network cards, tactile response devices, etc.

Various technologies might have been described in the general context of software, hardware element or program module herein. Generally speaking, such module includes routine, program, object, element, component, data structure, etc. for performing specific tasks or implementing specific abstract data types. Generally, the terms "module", "functionality" and "component" as used herein mean software, firmware, hardware or combinations thereof. Features of the technologies described herein are platform independent, which means that said technologies can be implemented on various computing platforms having various processors.

The software, hardware or program module and other program modules can be implemented as one or more instructions and/or logics that have been embodied on a certain form of computer-readable medium and/or be implemented by one or more hardware elements 804. The computing device 800 can be configured as implementing specific instructions and/or functions corresponding to software and/or hardware modules.

In various schemes of implementation, the computing device 800 may adopt various different configurations, such as computer, mobile device, TV, etc. The technologies described herein can be supported by said various configurations of the computing device 800 and are not limited to the specific examples of technologies as described herein. The functionalities can be implemented entirely or partially using a distributed system, such as implemented on a "cloud". Those skilled in the art shall understand that the drawings are merely schematic drawings of exemplary embodiments, and the modules or flows in the drawings are not necessarily indispensable for implementing the present disclosure.

Those skilled in the art can understand that modules in the devices described in the embodiments can be distributed in the ways as described in the embodiments, or they can be distributed in other ways than those described in the embodiments. Modules in the embodiments can be combined into one module, or they can be further divided into multiple sub-modules.

It shall be appreciated that in the descriptions of the present disclosure, the directional or positional relations indicated by such terms as "center", "longitudinal", "lateral", "length", "width", "thickness", "on", "under", "front", "back", "left", "right", "vertical", "horizontal", "top", "bottom", "inside", "outside", "clockwise", "counter-clockwise", "axial", "radial", "circumferential" are directional or positional relations as shown in the drawings, and said terms are merely used for facilitating description of the present disclosure and for simplifying the description, but they do not indicate or suggest that the described device or element must have a specific direction and position or be constructed and operated in a specific direction and position, so they shall not be construed as limiting the present disclosure.

Moreover, the terms "first" and "second" are used for descriptive purposes only, but they shall not be construed as indicating or suggesting any relative importance or implying the number of the described technical features. Therefore, the features defined by "first" and "second" may explicitly or implicitly include at least one of said features. In the descriptions herein, the word "multiple" means at least two, e.g. two, three, etc., unless otherwise defined.

In this disclosure, unless otherwise defined or specified, the terms like "install", "connect", "fix", etc. shall be interpreted in a broad sense, which, for example, may mean a fixed connection or a detachable connection or forming an integral; a mechanical connection or an electrical connection; a direct connection or an indirect connection through an intermediary, or internal connection within two elements or interaction between two elements, unless otherwise defined. Those ordinarily skilled in the art can understand the specific meaning of these terms in the present disclosure according to the specific situation.

In this disclosure, unless otherwise defined or specified, a first feature being "on" or "under" a second feature may mean that the first feature and the second feature are in immediate contact or that the first feature and the second feature are in indirect contact through an intermediary. Besides, the first feature being "above", "on top of" or "on" the second feature may mean that the first feature is right above or just above the second feature, or it may simply mean that the horizontal height of the first feature is higher than that of the second feature. The first feature being "under" or "below" the second feature may mean that the first feature is right below or just below the second feature, or it may simply mean that the horizontal height of the first feature is lower than that of the second feature.

In this specification, descriptions made with reference to "an embodiment", "some embodiments", "an example", "a specific example", "some examples", etc. mean that the specific features, structures, materials or characteristics described with reference to said embodiment or example are included in at least one embodiment or example of the present disclosure. In this specification, schematic expressions of the above terms are not necessarily used for the same embodiment or example. Moreover, the described specific features, structures, materials or characteristics can be combined in appropriate ways in any one or more embodiments or examples. In addition, those skilled in the art can combine different embodiments or examples and features of different embodiments or examples described in this specification as long as no confliction is caused.

Although the embodiments of the present disclosure have been illustrated and described in the text above, it shall be appreciated that the above embodiments are exemplary but they do not intend to limit the present disclosure. Those ordinarily skilled in the art can make changes, modifications, replacements and variations to the above embodiments without departing from the scope of the present disclosure.

The invention claimed is:

1. A driving method of a pixel circuit, comprising:

during a frame sequence formed by successive X frames of image displaying, outputting gate signals and data signals to the pixel circuit in a first preset mode;

during a frame sequence formed by successive Y frames and adjacent to the frame sequence formed by successive X frames of the image displaying, outputting gate signals and data signals to the pixel circuit in a second preset mode, wherein the first preset mode is different from the second preset mode, and X and Y are positive integers not less than 2;

wherein the first preset mode is one of a driving mode of forward Z inversion and a driving mode of reverse Z inversion, the second preset mode is the other one of a driving mode of forward Z inversion and a driving mode of reverse Z inversion;

wherein said outputting the gate signals and the data signals to the pixel circuit in the first preset mode comprises: grouping all rows of the pixel circuit by taking multiple rows of pixel units as one group, and in each group, outputting gate signals in a disorderly manner to all rows of the pixel units in said group; and wherein said outputting the gate signals and the data signals to the pixel circuit in the second preset mode comprises: outputting gate signals in sequence to all rows of pixel units of the pixel circuit.

2. The driving method according to claim 1, wherein under a condition that X and Y are 2, during the $N^{th}$ frame and the $(N+1)^{th}$ frame of the image displaying, outputting gate signals and data signals to the pixel circuit in the first preset mode, wherein N is a positive integer;

during an $(N+2)^{th}$ frame and an $(N+3)^{th}$ frame of the image displaying, outputting the gate signals and the data signals to the pixel circuit in the second preset mode.

3. The driving method according to claim 2, wherein said outputting the gate signals and the data signals to the pixel circuit in the first preset mode comprises: grouping all rows of the pixel circuit by taking every three rows of pixel units as one group, and in each group, outputting gate signals in an order of a first row, a third row and a second row to the pixel units;

said outputting the gate signals and the data signals to the pixel circuit in the second preset mode comprises: sequentially outputting gate signals to the pixel units in an order from the first row to a last row.

4. The driving method according to claim 3, wherein under a condition that outputting the gate signals to one row of pixel units, further outputting the corresponding data signals to each of the pixel units in said row.

5. The driving method according to claim 4, wherein data signals of the $N^{th}$ frame and the $(N+1)^{th}$ frame have opposite polarities, and data signals of the $(N+2)^{th}$ frame and the $(N+3)^{th}$ frame have opposite polarities.

6. The driving method according to claim 5, wherein under a condition that the data signals of the $N^{th}$ frame have a negative polarity, data signals of the $(N+1)^{th}$ frame have a positive polarity, the data signals of the $(N+2)^{th}$ frame have a negative polarity, and the data signals of the $(N+3)^{th}$ frame have a positive polarity.

7. A computing device, comprising:

a processor;

a non-transitory memory storing computer-executable instructions, which, when being executed by the processor, carries out the driving method according to claim 1.

8. A driving device of a pixel circuit, comprising:

a first driver configured to output gate signals and data signals to the pixel circuit in a first preset mode during a frame sequence formed by successive X frames of image displaying;

a second driver configured to output gate signals and data signals to the pixel circuit in a second preset mode during a frame sequence formed by successive Y frames and adjacent to the frame sequence formed by successive X frames of the image displaying, wherein the first preset mode is different from the second preset mode, and X and Y are positive integers not less than 2;

wherein the first preset mode is one of a driving mode of forward Z inversion and a driving mode of reverse Z inversion, the second preset mode is the other one of a driving mode of forward Z inversion and a driving mode of reverse Z inversion;

wherein in response to the first driver outputting the gate signals and the data signals to the pixel circuit in the first preset mode, the first driver groups all rows of the pixel circuit by taking multiple rows of pixel units as one group, and in each group, outputs the gate signals in a disorderly manner to all rows of the pixel units in said group; and wherein in response to the second driver outputting the gate signals and the data signals to the pixel circuit in the second preset mode, the second driver outputs gate signals in sequence to all rows of pixel units of the pixel circuit.

9. The driving device according to claim 8, wherein under a condition that X and Y are 2, the first driver is configured to output the gate signals and the data signals to the pixel circuit in the first preset mode during an $N^{th}$ frame and an $(N+1)^{th}$ frame of the image displaying, wherein N is a positive integer; and the second driver is configured to output the gate signals and the data signals to the pixel circuit in the second preset mode during the $(N+2)^{th}$ frame and the $(N+3)^{th}$ frame of the image displaying.

10. The driving device according to claim 9, wherein in response to the first driver outputting the gate signals and the data signals to the pixel circuit in the first preset mode, the first driver groups all rows of the pixel circuit by taking every three rows of pixel units as one group, and in each group, outputs gate signals in ane order of n first row, n third row and n second row to pixel units;

in response to the second driver outputting gate signals and data signals to the pixel circuit in the second preset mode, the second driver sequentially outputs gate signals to the pixel units in the order from the first row to the last row.

11. The driving device according to claim 10, wherein under a condition that either one of the first driver and the second driver outputs the gate signals to one row of pixel units, said either one of the drivers also outputs the corresponding data signals to each of a plurality of pixel units in the row.

12. The driving device according to claim 11, wherein the data signals of the $N^{th}$ frame and the $(N+1)^{th}$ frame have opposite polarities, and the data signals of the $(N+2)^{th}$ frame and the $(N+3)^{th}$ frame have opposite polarities.

13. The driving device according to claim 12, wherein under a condition that the data signals of the $N^{th}$ frame have a negative polarity, the data signals of the $(N+1)^{th}$ frame have a positive polarity, the data signals of the $(N+2)^{th}$ frame have a negative polarity, and the data signals of the $(N+3)^{th}$ frame have a positive polarity.

14. A pixel circuit, comprising the driving device according to claim 8.

15. A display device, comprises the pixel circuit according to claim 14.

16. The pixel circuit according to claim 14, wherein in response to the first driver outputting the gate signals and the data signals to the pixel circuit in the first preset mode, the first driver groups all rows of the pixel circuit by taking multiple rows of pixel units as one group, and in each group, outputs gate signals in a disorderly manner to all rows of the pixel units in said group.

* * * * *